United States Patent [19]

Moraly

[11] Patent Number: 4,520,545

[45] Date of Patent: Jun. 4, 1985

[54] METHOD FOR MANUFACTURING PINS PARTICULARLY INTENDED FOR ANCHORING IN THE GROUND POSTS OR STAKES, AND PINS OBTAINED THEREBY

[76] Inventor: Paul Moraly, 168, 170 rue Victor-Hugo, 93110 Rosny sous Bois, France

[21] Appl. No.: 547,575

[22] PCT Filed: Mar. 1, 1983

[86] PCT No.: PCT/FR83/00037

§ 371 Date: Oct. 19, 1983

§ 102(e) Date: Oct. 19, 1983

[87] PCT Pub. No.: WO83/03115

PCT Pub. Date: Sep. 15, 1983

[30] Foreign Application Priority Data

Mar. 5, 1982 [FR] France ..... 82 03681

[51] Int. Cl.[3] ..... B23D 17/00; E04H 12/20

[52] U.S. Cl. ..... 29/412; 52/153; 52/154

[58] Field of Search ..... 29/412; 52/153, 154

[56] References Cited

U.S. PATENT DOCUMENTS

| | | | |
|---|---|---|---|
| 2,206,625 | 7/1940 | Beach et al. | 52/154 |
| 2,227,553 | 1/1941 | Paque | 52/153 |
| 3,132,726 | 5/1964 | Johnson | 52/153 |
| 3,727,357 | 4/1973 | Stillman | 52/154 |
| 3,969,853 | 7/1976 | Deike | 52/154 |
| 4,004,383 | 1/1977 | Watanabe | 52/154 |
| 4,252,472 | 2/1981 | Maraly | 52/154 |

*Primary Examiner*—Howard N. Goldberg
*Assistant Examiner*—Steven Nichols
*Attorney, Agent, or Firm*—William A. Drucker

[57] ABSTRACT

Method of making, from a strip, (for example metallic) a peg including a prismatic sheath from at least one surface of which extends a fin shaped so as to facilitate its downward penetration into the ground and increase its strength in the transverse direction, characterized in that the method comprises: shaping a strip adapted to form a plurality of pegs so as to define on each edge thereof a straight prismatic sleeve (1, 2) having all along its longitudinal dimension an opening (11, 21) extending along its edge which connects it with the intermediate strip portion (3) joining both sleeves to each other; and cutting said shaped strip both in a direction orthogonal to the generatrixes of said prismatic sleeves (1, 2) to form sections ($A_1$, $B_1$, $A_2$, $B_2$) the length of which is equal to the vertical dimension of the peg, and, in each said section, along a diagonal plane ($A_1$, $B_1$). The method can be used for making pegs for fences.

16 Claims, 5 Drawing Figures

1
3
B2
A2
2
B1
10
20
A1
11
21

A13
a
A11
B11
B12
A12
B13

A1
22
B1
3

A1
B1

A1
B1

METHOD FOR MANUFACTURING PINS PARTICULARLY INTENDED FOR ANCHORING IN THE GROUND POSTS OR STAKES, AND PINS OBTAINED THEREBY

BACKGROUND OF THE INVENTION

The invention relates to anchoring of elements, especially but not exclusively fence posts or stakes, in the ground.

THE PRIOR ART

In the first Addition to French Pat. No. 79 09679 filed Apr. 10, 1979 by the Applicant for: "A peg for use in fastening posts or stakes in the ground, and devices for use in driving said pin in", there has been disclosed a peg consisting of two portions of shaped metal plates, preferably zigzag-shaped, each defining a fin shaped so as to facilitate its downwards penetration into the ground and to provide it with strength in the transverse direction after it has been driven down, said fin including a folded edge so as to form a prismatic sleeve open along an edge, these two sleeves being nested in each other to form a centrally extending prismatic sheath all along the peg vertical dimension.

Such a peg provides an effective anchorage of a stake which has only to be inserted into the sheath and does not need to be sealed. It can be easily installed and is sufficiently stiff even where it is made from a thin metal plate.

OBJECT OF THE INVENTION

The present invention relates to a method of making pegs of the above-mentioned kind, adapted to reduce the machining steps and the amount of scrap metal, which can be made by a continuous method of manufacture from a strip and adapted to provide varying forms suitable to all requirements.

SUMMARY OF THE INVENTION

The method in accordance with the invention is mainly characterized in that the above-described sleeve is obtained by shaping both edges of a strip adapted to form a plurality of pegs, and each fin is obtained by cutting the strip material both in a direction orthogonal to the sleeve generatrixes to form sections of the thus shaped strip each having a length corresponding to the peg vertical dimension, and, on the other hand along a diagonal plane of each section.

By so diagonally cutting each section, there are provided a pair of fins which may be folded or bent during the edge shaping step and the sleeves of which, advantageously being open only by a slot adapted to enable the two sleeves of the two fins to be locked to each other so that the two fins can preferably be joined to each other through their respective sleeves sliding into each other, will thus become bevelled at one end thereof and, without any additional machining, be shaped into a pointed tip allowing penetration, the corresponding amount of scrap metal being very small and dropping by itself upon said diagonal cutting.

Other features and advantages of the invention will become readily apparent from the detailed disclosure hereinbelow.

DESCRIPTION OF THE PREFERRED EMBODIMENT

Figures 1, 2, 3, 4, 5:
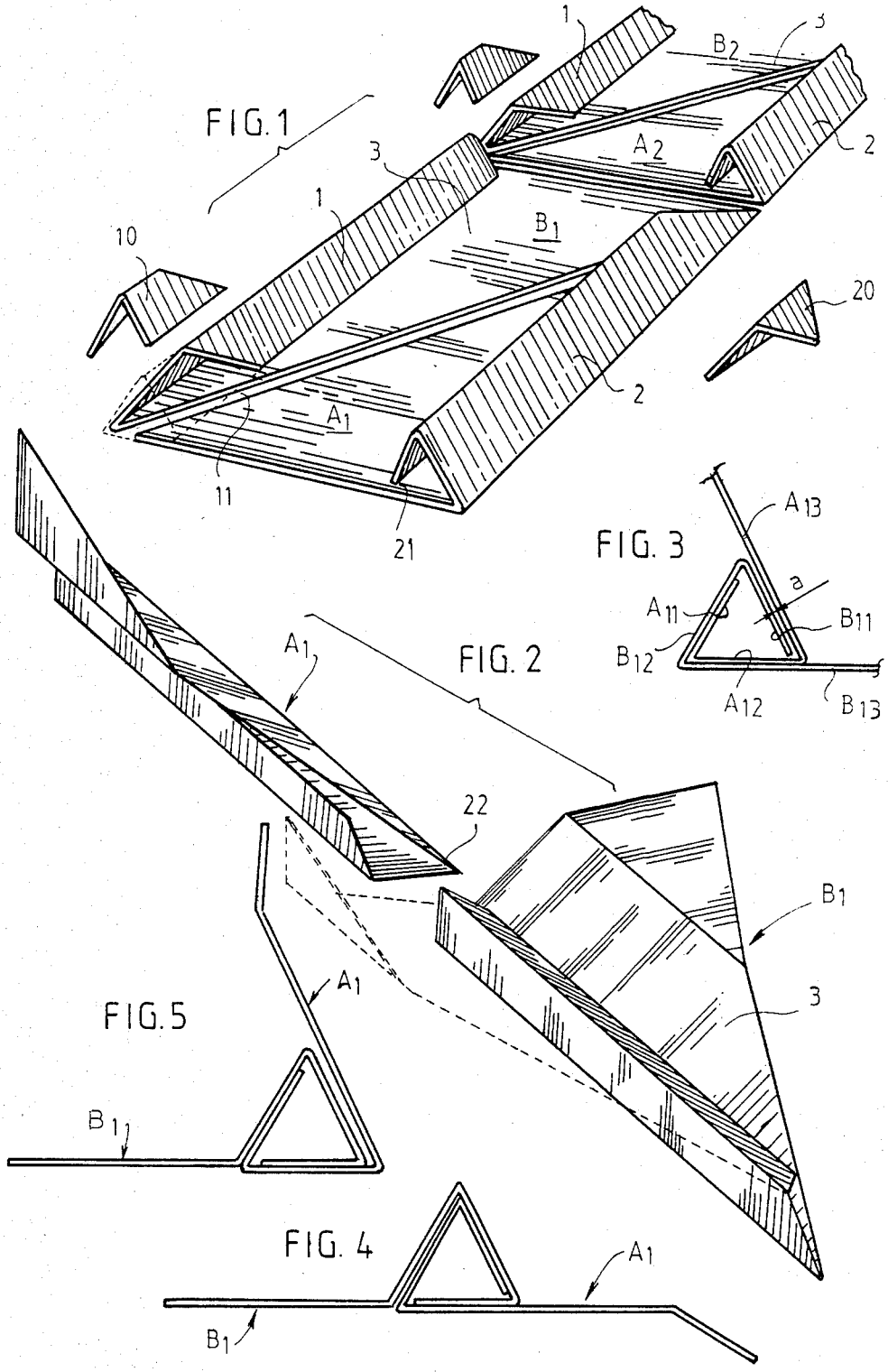
FIG. 1 shows the shaped and cut strip sections illustrating the method of the invention.
FIG. 2 shows how half-sections of the strip are joined to each other to form a peg.
FIG. 3 is a side elevation of a peg sheath obtained through interlocking of the two sleeves of the respective half-sections.
FIGS. 4 and 5 show end views of two different modes of assembly of the same half-sections being unsymmetrically folded.

The method of the invention, in a first embodiment thereof, comprises continuously forming a shaped section from a long strip, e.g. of metal plate, by means of a press, by folding the strip edges to form sleeves 1 and 2 and, if appropriate, by folding or bending the intermediate strip portion 3, and then continuously cutting said shaped section into sections $A_1$, $B_1$, $A_2B_2$, . . . along cutting lines in succession perpendicular to the sleeve generatrixes and diagonal thereto, i.e. extending from a corner of a section such as $A_1B_1$ to the opposite corner of the same section.

All the half-sections $A_1$, $B_1$, etc. are exactly identical to each other in the embodiment of FIG. 1 wherein the intermediate strip portion 3 has been left planar and sleeves 1 and 2 are fully symmetrical. It would be the same if the strip portion 3 had been symmetrically bent. The sleeves have a prismatic surface open along an edge thereof, the opening being in fact a mere slot 11, 21. It should be noted that under such conditions the diagonal cutting results for each half-section in a small amount of scrap metal such as 10 or 20 which drops by itself. Thus, no additional machining is required for removing scrap metal, whereby there is provided a leading angle onto a fold line which increases stiffness to the pointed tip and enables the peg to better penetrate into the ground.

It should be understood that instead of the cuts being carried out on a continuously moving strip a stationary cutting line could be used, or the step sequence could be arranged in quite another order, provided however that a plurality of sections of shaped strip be handled simultaneously, each section corresponding to the vertical dimension of a peg, as described hereafter.

Indeed, although each of the shaped half-sections $A_1$, $B_1$, etc. can be used as a peg, it will be preferred to form each peg by joining together two half-sections while feeding, as shown in FIG. 2, the half-section $A_1$ behind the half-section $B_1$, the latter having been retained in the position illustrated in FIG. 1, whereas $A_1$ has been inverted so that the tip 22 of its sleeve engages into the slot in the sleeve $B_1$, at the straight-cut end of the latter: it can thus be seen that two of the surfaces of the sleeve $A_1$ engage into the sleeve $B_1$ while the third surface of the $A_1$ sleeve, from which the fin extends, remains outside the $B_1$ sleeve. Such an arrangement is shown in FIG. 3, where the $A_1$ surfaces are identified as $A_{11}$, $A_{12}$, $A_{13}$ and the $B_1$ surfaces are identified by $B_{11}$, $B_{12}$, $B_{13}$. It should be obvious that, if the cross-sectional dimensions of both sleeves are exactly the same, there will be left a gap a between surfaces $B_{11}$ and $A_{13}$. In order to achieve a better nesting, it may be advantageous to eliminate such a gap by reducing the cross-sectional area of one sleeve (here the $A_1$ sleeve) with respect to the other ($B_1$).

In FIG. 2, the broken line illustrates the final position of $A_1$ in the finished peg. The two bevelled tips of the $A_1$ and $B_1$ sleeves obviously facilitate penetration of the peg into the ground. No welding step is required to complete the peg.

The center sheath resulting from interlocking of both sleeves has a double thickness of metal on its three surfaces, which increases its stiffness. In addition, a wide variety of shapes can be achieved as needed.

In FIGS. 1 to 3, pegs the center sheath of which has a cross-sectional area shaped as an equilateral triangle are shown. It should be noted that this particularly advantageous embodiment is very difficult to make by the previously known methods.

As the need may be, the above-described method can obviously provide sleeves having a square, rectangular or any other appropriate polygonal cross-section.

Instead of being flat as shown in FIG. 1 or symmetrically foldable as shown in FIG. 2, the intermediate strip portion connecting both sleeves may have a strongly unsymmetrical shape as shown in FIGS. 4 and 5. In this case, depending upon the manner in which both half-sections $A_1$ and $B_1$ are engaged into each other, one obtains either a nearly flat-shaped peg, as shown in FIG. 4, or a peg so shaped that both fins make an acute angle with each other, as shown in FIG. 5, which may be advantageous in some uses.

Instead of being made of metal, the shaped strip could be made of plastic, there are known forming methods using e.g. a pull action and simultaneous push action on the shaped section being formed, whereby half-closed shaped edges can be formed on such a strip.

We claim:

1. A method of making, from a strip, a peg including a prismatic sheath from at least one surface of which extends a fin shaped so as to facilitate its downward penetration into the ground and provide strength in the transverse direction, characterized in that the method comprises: shaping a strip adapted to form a plurality of pegs so as to define on each edge thereof a straight prismatic sleeve (1, 2) having all along its longitudinal dimension an opening (11, 21) extending along its edge which connects it with the intermediate strip portion (3) joining both sleeves to each other; and cutting said shaped strip both in a direction orthogonal to the generatrixes of said prismatic sleeves (1, 2) to form sections ($A_1$, $B_1$, $A_2$, $B_2$) the length of which is equal to the vertical dimension of the peg, and, in each said section, along a diagonal plane ($A_1$, $B_1$).

2. A method according to claim 1, characterized in that said opening is a slot (11, 20, 21) through which said sleeves can be interlocked.

3. A method according to claim 1, characterized in that the two half-sections ($A_1$, $B_1$) resulting from said diagonal and generatix orthogonal cutting are assembled by sliding their respective sleeves into each other.

4. A method according to claim 3, characterized in that said intermediate strip portion is symmetrically bent during the shaping step.

5. A method according to claim 3, characterized in that said intermediate strip portion is unsymmetrically bent during the shaping step.

6. A method according to claim 5, characterized in that the cross-sectional area of both said sleeves is shaped as an equilateral triangle.

7. A method according to claim 6, characterized in that said sleeves ($A_{11}$, $A_{12}$, $A_{13}$ and $B_{11}$, $B_{12}$, $B_{13}$) have non-equal cross-sectional areas such that the gap between two of the surfaces ($B_{11}$, $A_{12}$) superimposing to each other upon said interlocking becomes reduced.

8. A method according to claim 2, characterized in that the two half-sections ($A_1$, $B_1$) resulting from said diagonal and generatix orthogonal cutting are assembled by sliding their respective sleeves into each other.

9. A method according to claim 1 characterized in that said intermediate strip portion is symmetrically bent during the shaping step.

10. A method according to claim 2 characterized in that said intermediate strip portion is symmetrically bent during the shaping step.

11. A method according to claim 8 characterized in that said intermediate strip portion is symmetrically bent during the shaping step.

12. A method according to claim 1 characterized in that said intermediate strip portion is unsymmetrically bent during the shaping step.

13. A method according to claim 2 characterized in that said intermediate strip portion is unsymmetrically bent during the shaping step.

14. A method according to claim 8 characterized in that said intermediate strip portion is unsymmetrically bent during the shaping step.

15. A method according to claim 1 characterized in that the cross-sectional area of both said sleeves is shaped as an equilateral triangle.

16. A method according to claim 15 characterized in th t said sleeves ($A_{11}$, $A_{12}$, $A_{13}$ and $B_{11}$, $B_{12}$, $B_{13}$) have non-equal cross-sectional areas such that the gap between two of the surfaces ($B_{11}$, $A_{12}$) superimposing to each other upon said interlocking becomes reduced.

* * * * *